US009145274B2

(12) United States Patent
Sato et al.

(10) Patent No.: US 9,145,274 B2
(45) Date of Patent: Sep. 29, 2015

(54) SHEET STORAGE CASSETTE AND IMAGE FORMING APPARATUS INCLUDING SAME

(71) Applicant: KYOCERA Document Solutions Inc., Osaka (JP)

(72) Inventors: Masaki Sato, Osaka (JP); Shinsaku Yoneda, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/507,456

(22) Filed: Oct. 6, 2014

(65) Prior Publication Data

US 2015/0097330 A1 Apr. 9, 2015

(30) Foreign Application Priority Data

Oct. 8, 2013 (JP) ..... 2013-210997

(51) Int. Cl.

*B65H 1/08* (2006.01)
*B65H 1/14* (2006.01)
*B65H 1/04* (2006.01)

(52) U.S. Cl.

CPC .. *B65H 1/14* (2013.01); *B65H 1/04* (2013.01); *B65H 1/08* (2013.01); *B65H 2405/1117* (2013.01); *B65H 2405/1142* (2013.01); *B65H 2405/11425* (2013.01)

(58) Field of Classification Search

CPC ..... B65H 1/00; B65H 1/08; B65H 2405/10; B65H 2405/11; B65H 2405/11151; B65H 2405/1116; B65H 2405/11162; B65H 2405/1117; B65H 2405/114; B65H 2405/1142; B65H 2405/11425; B65H 2405/1144

USPC ..... 271/171

See application file for complete search history.

(56) References Cited

U.S. PATENT DOCUMENTS

| | | | | |
|---|---|---|---|---|
| 8,371,574 | B2 * | 2/2013 | Ichikawa et al. | 271/160 |
| 8,702,093 | B2 * | 4/2014 | Hirahara | 271/169 |
| 2008/0036140 | A1 * | 2/2008 | Inoue | 271/265.01 |
| 2009/0309295 | A1 * | 12/2009 | Taguchi | 271/147 |
| 2010/0044956 | A1 * | 2/2010 | Ko | 271/162 |
| 2013/0270765 | A1 * | 10/2013 | Araaki et al. | 271/171 |

FOREIGN PATENT DOCUMENTS

| | | | |
|---|---|---|---|
| JP | 9-110219 | A | 4/1997 |
| JP | 9-150960 | A | 6/1997 |
| JP | 2005-96958 | A | 4/2005 |

* cited by examiner

*Primary Examiner* — Jeremy R Severson
(74) *Attorney, Agent, or Firm* — Stein IP, LLC

(57) ABSTRACT

A sheet storage cassette includes a cassette base, a sheet stacking plate, a lift portion, and a pair of width adjustment cursors. At least one of the width adjustment cursors has an opposing surface facing a side edge of sheets, an opening formed in the opposing surface, a restriction member, a swing support shaft, and a first biasing member. The restriction member has an arm portion, a restriction portion selectively located at a first position where the restriction portion is retracted in an inner side of the opposing surface and a second position where the restriction portion projects from the opening, and a pressed portion extending to face an under surface of the sheet stacking plate. The swing support shaft swingably supports the arm portion of the restriction member. The first biasing member biases the restriction member in a direction of the second position.

12 Claims, 4 Drawing Sheets

SHEET STORAGE CASSETTE AND IMAGE FORMING APPARATUS INCLUDING SAME

INCORPORATION BY REFERENCE

This application is based upon and claims the benefit of priority from the corresponding Japanese Patent Application No. 2013-210997 filed on Oct. 8, 2013, the entire contents of which are incorporated herein by reference.

BACKGROUND OF THE INVENTION

The present disclosure relates to a sheet storage cassette in which recording medium sheets are stored, and an image forming apparatus, such as a copier, a printer, and a facsimile, to which such a sheet storage cassette is withdrawably attached.

A sheet feeding cassette for an image forming apparatus is configured to accept sheets (recording medium sheets) of various standard sizes such as the A series, the B series, and the inch series. Positions of edge portions of stored sheets are restricted by, for example, a width adjustment cursor and a rear end cursor, which are both slidable to positions corresponding to the size of the stored sheets.

If the position of the stored sheets is insufficiently restricted by the above-mentioned width adjustment cursor, it may invite sheet skew (oblique sheet feeding) in the sheet feeding cassette in an operation of feeding out the sheets from the sheet feeding cassette. This prevents a stable sheet feeding operation, causing trouble such as a paper jam, which is disadvantageous.

As a solution to this disadvantage, there has been known a sheet feeding cassette having a width adjustment cursor and a rear end cursor that are biased by a spring toward an opening side, such that the width adjustment cursor and the rear end cursor open a storage portion on detachment of the sheet feeding cassette from an image forming apparatus and such that the width adjustment cursor and the rear end cursor move toward a non-opening side to restrict the position of a sheet on attachment of the sheet feeding cassette to the image forming apparatus body.

SUMMARY OF THE INVENTION

According to one aspect of the present disclosure, a sheet storage cassette includes a cassette base, a sheet stacking plate, a lift portion, and a pair of width adjustment cursors. The sheet storage cassette is insertable and withdrawable with respect to a body of an image forming apparatus. The cassette base stores sheets (recording medium sheets). The sheet stacking plate is disposed such that an upstream-side end portion thereof in a feeding direction of the sheets is rotatably supported on a bottom of the cassette base, and the sheets are placed on an upper surface of the sheet stacking plate. The lift portion moves the sheet stacking plate up and down between a lower limit position where the sheet stacking plate is parallel to the bottom of the cassette base and the sheet can be set on the sheet stacking plate, and a sheet feeding position where the sheet can be fed out of the sheet storage cassette. At least one of the width adjustment cursors is provided with an opposing surface, an opening, a restriction member, a swing support shaft, and a first biasing member. The opposing surface faces a side edge of the sheets paced on the sheet stacking plate. The opening is formed in the opposing surface. The restriction member includes an arm portion extending in an up-down direction of the width adjustment cursor, a restriction portion formed at an upper end portion of the arm portion so as to be selectively located at a first position where the restriction portion is retracted in an inner side of the opposing surface or a second position where the restriction portion projects outside from the opening to restrict a position of the side edge of the sheets, and a pressed portion extending from a lower end portion of the arm portion outward in the sheet width direction to project from a lower end portion of the width adjustment cursor to face an under surface of the sheet stacking plate. The swing support shaft, which is provided in the width adjustment cursor, swingably supports the arm portion of the restriction member. The first biasing member biases the restriction member so that the restriction portion swings in a direction of the second position. When the sheet stacking plate is located at the lower limit position with respect to the cassette base, the pressed portion is pressed by the sheet stacking plate into a pressed state, causing the restriction portion to swing in a direction of the first position against a biasing force of the first biasing member, and when the sheet stacking plate rises up to the sheet feeding position, the pressed state of the pressed portion is released and the restriction portion is caused to swing in the direction of the second position by the biasing force of the first biasing member.

Still other objects and specific advantages of the present disclosure will become apparent from the following descriptions of preferred embodiments.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
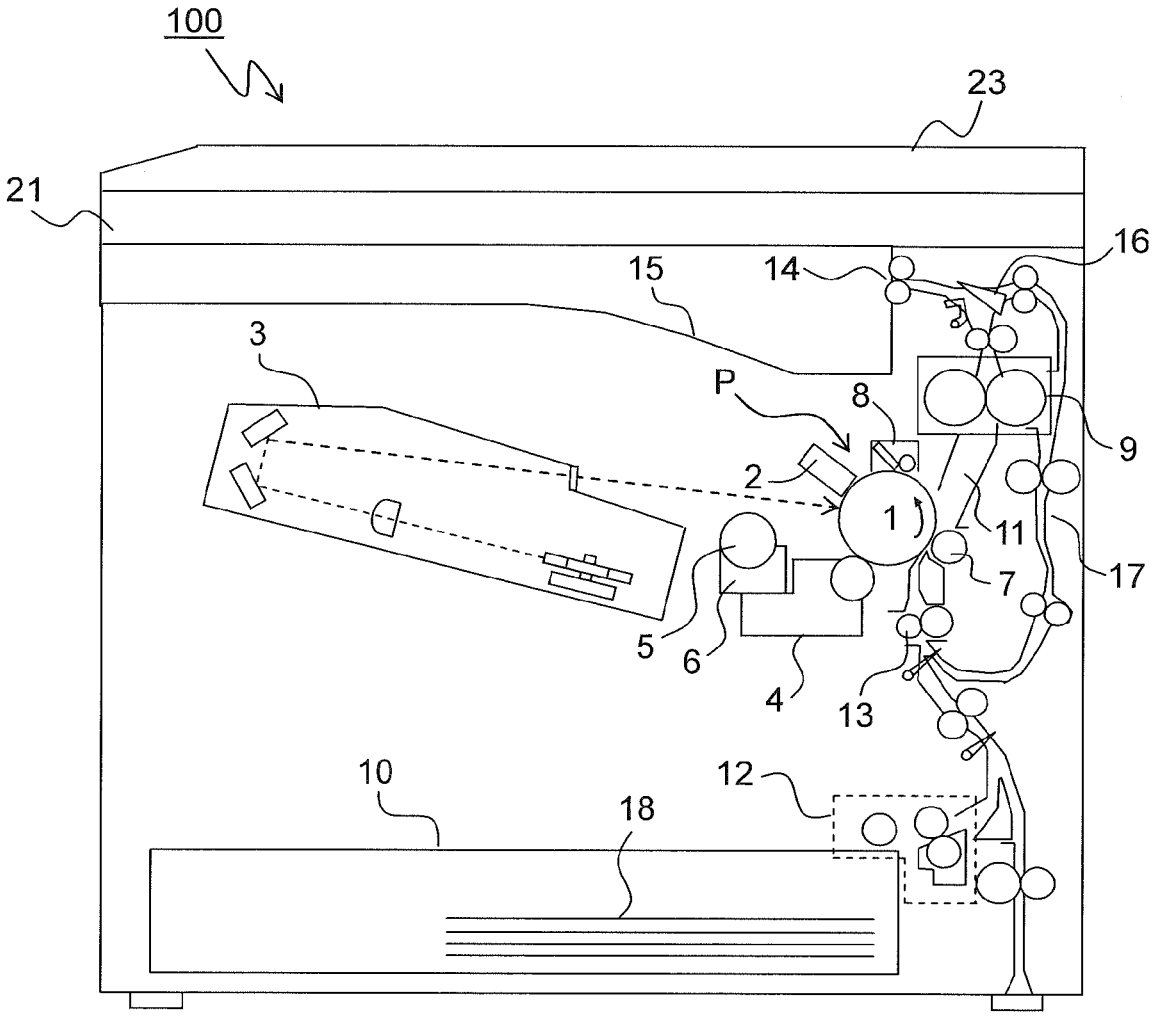
FIG. 1 is a schematic sectional view showing an image forming apparatus 100 including a sheet feeding cassette 10 according to one embodiment of the present disclosure.
Figure 2:
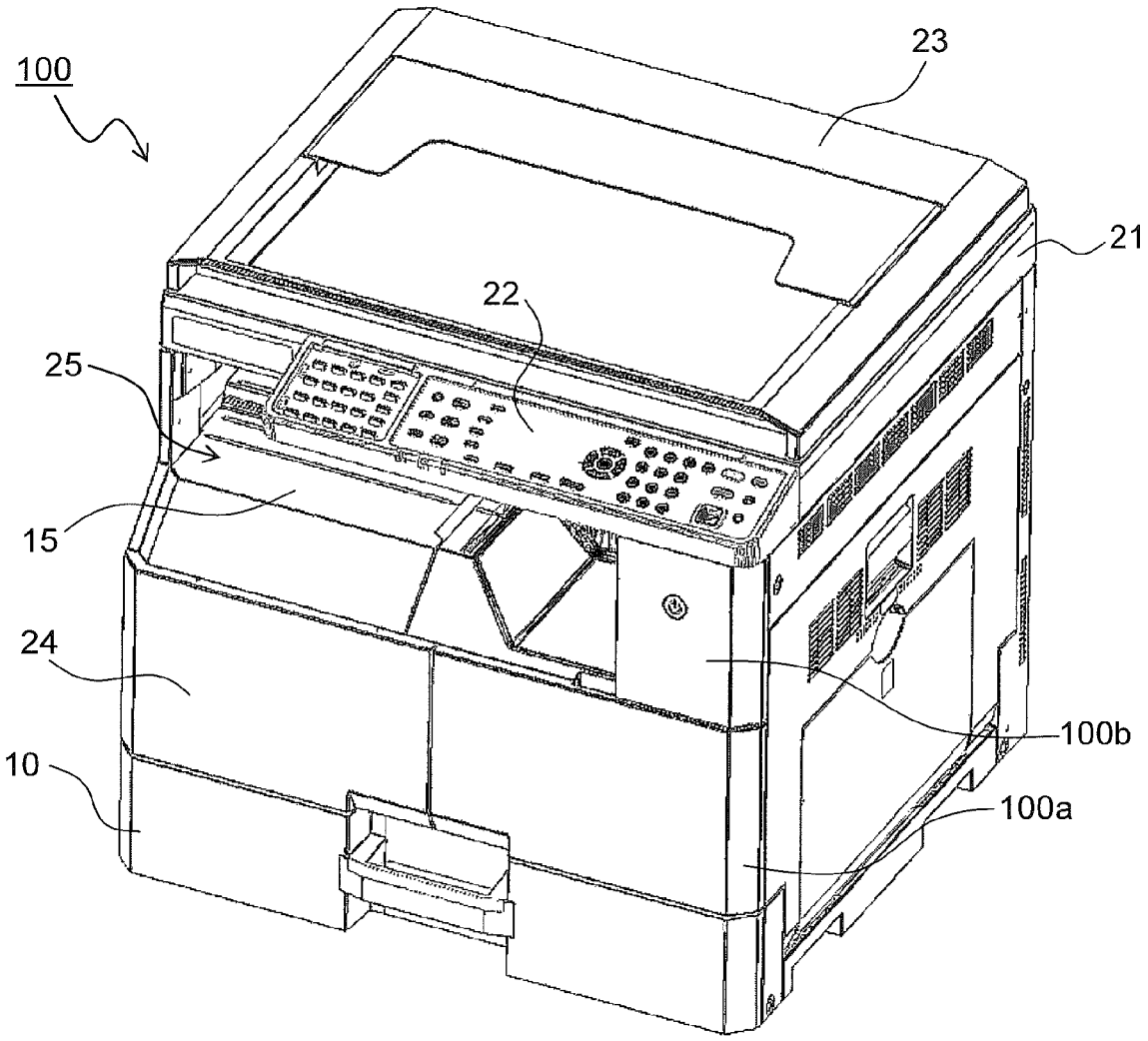
FIG. 2 is an external perspective view of the image forming apparatus 100 as seen from its front face side.

Hereinafter, embodiments of the present disclosure will be described with reference to the accompanying drawings. FIG. 1 is a schematic sectional view showing an image forming apparatus 100 provided with a sheet feeding cassette 10 according to one embodiment of the present disclosure. FIG. 2 is an external perspective view showing the image forming apparatus 100 as seen from its front face side (front side of FIG. 1). Note that herein a monochrome multifunction peripheral (MFP) is shown as the image forming apparatus 100. Inside a body of the image forming apparatus 100, an image forming portion P is disposed. The image forming portion P is configured to form a monochrome image through charging, exposure, developing and transfer processes.

In the image forming portion P, along a rotation direction of a photosensitive drum 1 (counterclockwise direction in FIG. 1), there are arranged a charging portion 2, an exposure unit 3, a developing device 4, a transfer roller 7, a cleaning device 8, and a charge removing device (not shown). In the image forming portion P, an image forming process is performed with respect to the photosensitive drum 1 rotating in the counterclockwise direction in FIG. 1.

The photosensitive drum 1 is formed of, for example, an aluminum drum and a photosensitive layer laid on the aluminum drum, and its surface is electrically charged by the charging portion 2. When the charged surface of the photosensitive drum 1 is irradiated with a laser beam from the exposure unit 3, which will be described later, an electrostatic latent image is formed on the surface of the photosensitive drum 1 through attenuation of electric charge.

The charging portion 2 uniformly charges the surface of the photosensitive drum 1. Used as the charging section 2 is, for example, a corona discharge device which produces electric discharge by applying a high voltage to an electrode such as a piece of fine wire. The exposure unit 3 irradiates the photosensitive drum 1 with a light beam (for example, a laser beam) according to image data of a document read at an image reading portion 21, to thereby form an electrostatic latent image on the surface of the photosensitive drum 1.

The developing device 4 causes toner to adhere to the electrostatic latent image formed on the photosensitive drum 1, to thereby form a toner image. Supply of toner to the developing device 4 is performed from a toner container 5 via an intermediate hopper 6.

The transfer roller 7 transfers, without disturbing, the toner image formed on the surface of the photosensitive drum 1 onto a sheet conveyed thereto along a sheet conveyance path 11. The cleaning device 8 is provided with a cleaning roller, a cleaning blade, or the like that is positioned in line contact with the photosensitive drum 1 in a longitudinal direction thereof to remove residual toner remaining on the surface of the photosensitive drum 1 after the transfer of the toner image onto the sheet.

The image reading portion 21 is configured with, for example, a scanning optical system provided with a scanner lamp that irradiates a document with light in a copying operation and a mirror that changes an optical path of light reflected from the document, a condensing lens that condenses the light reflected from the document and forms an image, a CCD sensor that converts the light of the formed image into an electric signal, and the like (none of which is shown), and the image reading portion 21 reads a document image and converts the read document image into image data.

When a copying operation is performed, image data of a document is read and converted into an image signal at the image reading portion 21. On the other hand, in the image forming portion P, the photosensitive drum 1, which rotates in the counterclockwise direction in the figure, is uniformly charged by the charging portion 2. Then, based on the image data of the document read at the image reading portion 21, the exposure unit 3 irradiates the photosensitive drum 1 with a laser beam (light beam), and thereby, an electrostatic latent image is formed based on the image data on the surface of the photosensitive drum 1. Thereafter, the developing device 4 causes toner to adhere to the electrostatic latent image, and thereby a toner image is formed.

Toward the image forming portion P where the toner image has been formed in the above-described manner, a sheet feeding unit 12 sends a sheet 18 from a sheet feeding cassette 10, and the sheet 18 is conveyed via a sheet conveyance path 11 and a registration roller pair 13 to the image forming portion P at a predetermined timing. Then, in the image forming portion P, the toner image formed on the surface of the photosensitive drum 1 is transferred onto the sheet 18 by the transfer roller 7. The sheet 18 onto which the toner image has been transferred is separated from the photosensitive drum 1 to be conveyed to a fixing portion 9, where heat and pressure are applied to the sheet 18, and thereby the toner image is fixed on the sheet 18.

The conveying direction of the sheet 18 after passing the fixing portion 9 is sorted by a branching portion 16 that is branched in a plurality of directions. In a case of forming an image only on one side of the sheet 18, the sheet 18 is discharged directly onto a discharge tray 15 by a discharge roller pair 14.

On the other hand, in a case of forming an image on each side of the sheet 18, the sheet 18 that has passed through the fixing portion 9 is once conveyed in the direction of the discharge roller pair 14, and then, after a rear end of the sheet 18 passes through the branching portion 16, the discharge roller pair 14 is rotated reversely while the conveying direction in the branching portion 16 is switched. Thereby, the sheet 18 is sorted to a reverse conveyance path 17 with its rear end oriented to the proceeding direction, and is conveyed back to the registration roller pair 13 with the image side of the sheet 18 reversed. Then, a next image formed on the photosensitive drum 1 is transferred by the transfer roller 7 onto a side of the sheet 18 on which no image has been formed, and then, after the sheet 18 is conveyed to the fixing portion 9 and the toner image is fixed on the sheet 18, the sheet 18 is discharged onto the discharge tray 15.

As shown in FIG. 2, on an upper surface of the image reading portion 21, there are provided a document placing table (not shown) to which a transparent glass plate (contact glass) is attached, and an operating panel 22 projecting on a front face side of the body of the image forming apparatus 100. Moreover, on the upper surface of the image reading portion 21, a platen (document holder) 23 is openably/closably supported to hold a document placed on the document placing table.

Furthermore, on a front face side of a housing 100*a*, a front cover 24 is openably/closably disposed. By opening the front cover 24, maintenance and replacement of each member arranged in the housing 100*a* is performed.

Figure 3:
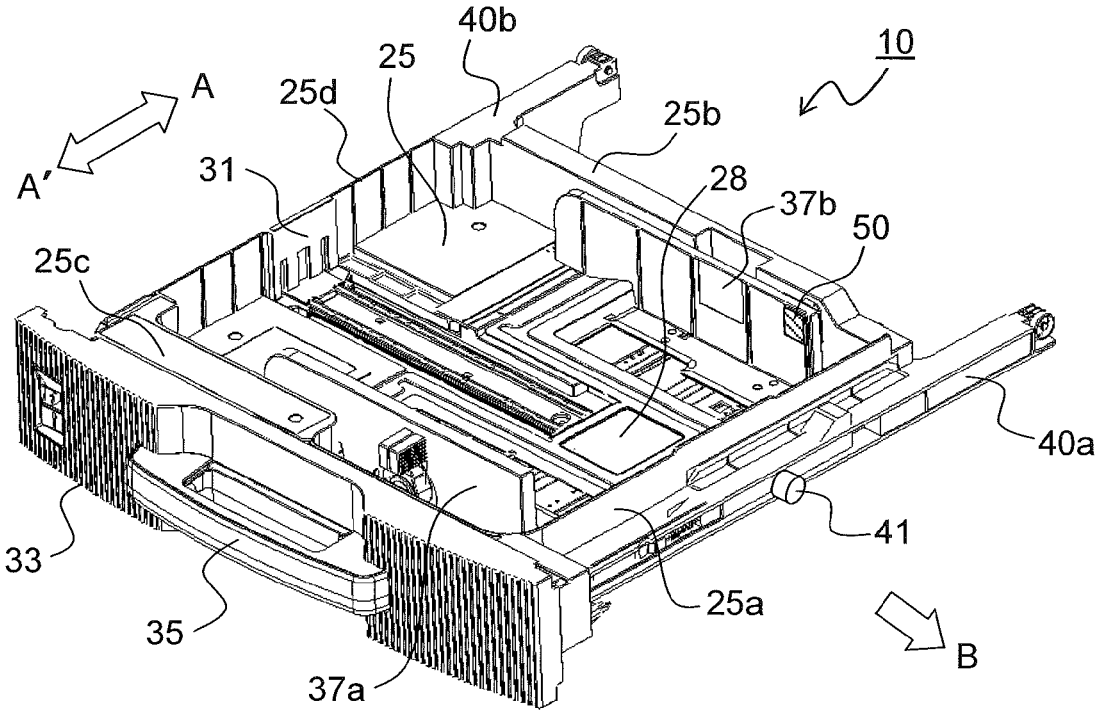
FIG. 3 is an external perspective view of the sheet feeding cassette 10 to be attached to the image forming apparatus 100.

FIG. 3 is an external perspective view of a sheet feeding cassette 10 to be attached to the image forming apparatus 100. Note that the front left side in FIG. 3 is the front face side (front side of FIG. 2) of the image forming apparatus 100. Moreover, in FIG. 3, an arrow A shows an inserting direction, and an arrow A' shows a withdrawing direction, of the sheet feeding cassette 10 with respect to the housing 100*a*, and an arrow B shows a sheet feeding direction in which a sheet is fed out from the sheet feeding cassette 10.

As shown in FIG. 3, wall portions 25*a*-25*d* are provided to stand at four peripheral portions of a cassette base 25 constituting a base of the sheet feeding cassette 10. To the wall portion 25*c*, which is located upstream with respect to the inserting direction of the sheet feeding cassette 10, there is attached a cassette cover 33. The cassette cover 33 has its front face side (left side in FIG. 3) exposed outward to constitute part of an outer surface of the image forming apparatus 100 (see FIG. 2). Moreover, at a center portion of the cassette cover 33, there is provided a grip portion 35 to be gripped in attaching and detaching the sheet feeding cassette 10.

A sheet stacking plate 28, on which a stack of sheets 18 (see FIG. 1) are stacked, is supported at an inner side of a bottom of the cassette base 25 with an upstream-side end portion of the sheet stacking plate 28 with respect to the sheet feeding direction (the arrow B direction) as a pivot, such that the sheet stacking plate 28 is swingable up and down in a swinging direction with a downstream-side end portion thereof with respect to the sheet feeding direction as a free end (swingable end). The free end of the sheet stacking plate 28 is biased by a compression spring 57 upward in the swinging direction (see FIG. 4). The sheet stacking plate 28 is a plate-like member provided with a cutout formed in moving areas of width adjustment cursors 37*a*, 37*b*, and a rear end cursor 31, which will be described later.

A right wall portion 25*a* of the sheet feeding cassette 10 is provided with a lock release member 41 that is caused to project outward from the right wall portion 25*a* by a biasing force of a spring (not shown) provided in the sheet feeding cassette 10. The lock release member 41 has a locking claw (not shown) that holds the swingable end (right end in FIG. 2) of the sheet stacking plate 28. Before the sheet feeding cassette 10 is inserted into the body of the image forming apparatus 100, the locking claw holds the swingable end of the sheet stacking plate 28 by pressing the sheet stacking plate 28 against the base of the sheet feeding cassette 10, and thereby the sheet stacking plate 28 is locked. In this state, when the sheet feeding cassette 10 is inserted into the body of the image forming apparatus 100, an end portion of the lock release member 41 comes in contact with a contact piece (not shown) provided at the body of the image forming apparatus 100, and thereby the lock release member 41 is once pressed into an inner side of the right wall portion 25*a*. At this time, engagement between the locking claw and the sheet stacking plate 28 is released, and thereby the locked state of the sheet stacking plate 28 is released. The lock release member 41 and the compression spring 57 constitute a lift mechanism (lift portion) that moves the sheet stacking plate 28 up and down between a lower limit position that is parallel to the bottom of the cassette base 25 and a sheet feeding position.

On two sides of the sheet stacking plate 28 opposing each other in a sheet width direction (arrows AA' direction) that is perpendicular to the sheet feeding direction, there is provided a pair of width adjustment cursors 37*a*, 37*b* that stand along the sheet feeding direction. The width adjustment cursors 37*a*, 37*b* each contact a side of the stack of sheets 18 stacked on the sheet stacking plate 28 from both sides in the sheet width direction (the arrows AA' direction), to thereby perform positioning in the sheet width direction such that the sheets 18 are positioned at the sheet feeding position to be fed out by a pickup roller and a sheet feeding roller pair (neither is shown). The width adjustment cursors 37*a*, 37*b* are movable along a width adjustment cursor moving groove (not shown) provided at the inner side of the bottom of the cassette base 25 and extending in the sheet width direction.

At an upper end portion of the width adjustment cursor 37*b*, there is provided a restriction member 50 that projects inward in the sheet width direction (toward the sheet stacking plate 28) at the swingable end of the sheet stacking plate 28 side (downstream side in the sheet feeding direction, right side in FIG. 2). It is by the restriction member 50 that a position of a side end portion 18*a* (see FIG. 4), which is on the downstream side in the sheet feeding direction, of the stack of sheets 18 stacked on the sheet stacking plate 28 is restricted. A configuration of the restriction member 50 will be described later in detail.

Moreover, since the sheets 18 are sent out in the arrow B direction toward a sheet conveyance path 11 (see FIG. 1), the rear end cursor 31 that aligns the rear end of the stack of sheets 18 is provided to be reciprocatingly movable in a direction that is parallel to the sheet feeding direction (the arrow B direction) along the rear end cursor moving groove (not shown) formed in the cassette base 25. By moving the rear end cursor 31 and the width adjustment cursors 37*a*, 37*b* in accordance with a size of the stack of sheets 18 stacked on the sheet stacking plate 28, the stack of sheets 18 are stored at a predetermined position in the sheet feeding cassette 10.

Outside the wall portions 25*a*, 25*d* that are parallel to the inserting or withdrawing direction (the arrows A, A' direction) of the sheet feeding cassette 10, guide rails 40*a*, 40*b* are attached along the wall portions 25*a*, 25*d*, respectively. On the body of the image forming apparatus 100 (the housing 100*a* side), there are provided support portions (not shown) that slidably support the guide rails 40*a*, 40*b*. By sliding the guide rails 40*a*, 40*b* along the support portions, it is possible to insert and withdraw the sheet feeding cassette 10 with respect to the housing 100*a*.

Figure 4:
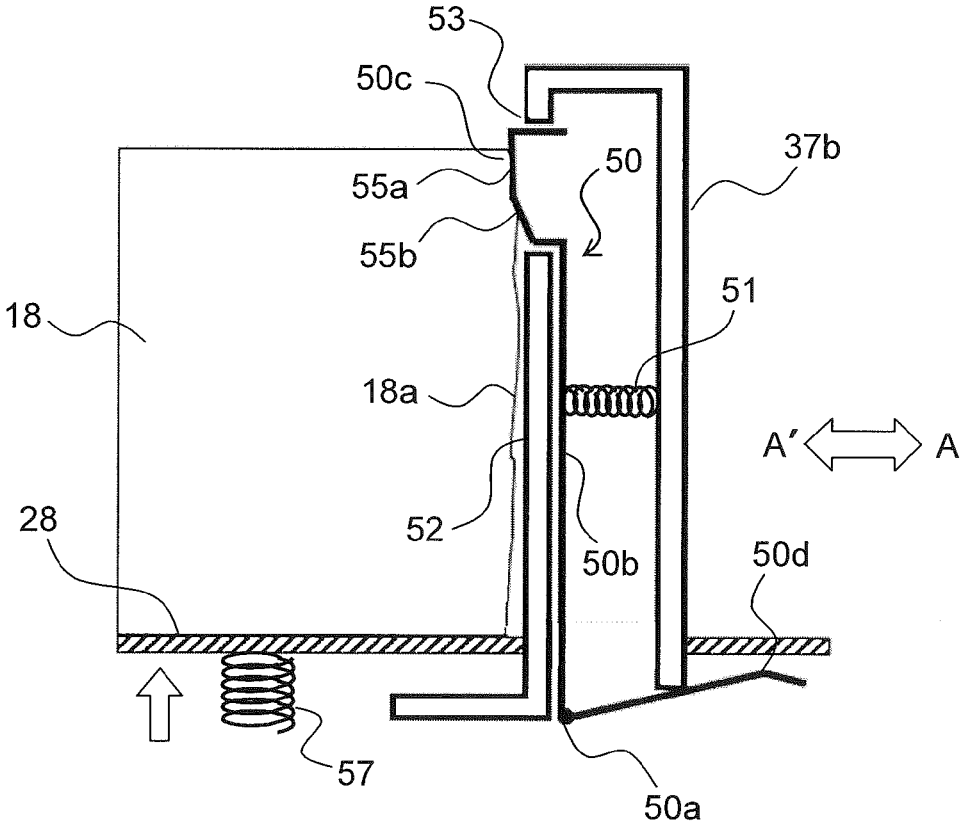
FIG. 4 is a partial sectional view obtained by cutting a portion in the vicinity of a pressing-side cursor 37*b* of the sheet feeding cassette 10 along a sheet width direction, showing a state of when sheets 18 are fed out of the sheet feeding cassette 10.
Figure 5:
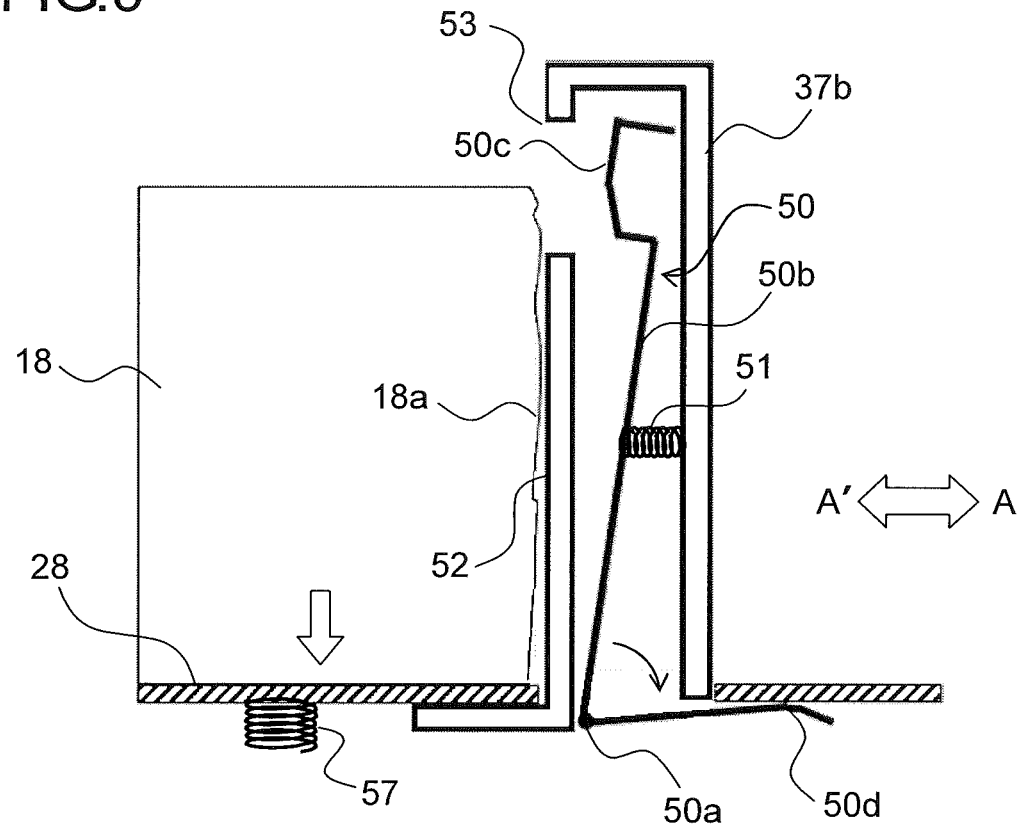
FIG. 5 is a partial sectional view obtained by cutting the portion in the vicinity of the pressing-side cursor 37*b* of the sheet feeding cassette 10 along the sheet width direction, showing a state when the sheets 18 are supplied into the sheet feeding cassette 10.

FIG. 4 and FIG. 5 are partial sectional views obtained by cutting a portion of the sheet feeding cassette 10 in the vicinity of the width adjustment cursor 37*b* along the sheet width direction. Note that FIG. 4 shows a state where the sheet feeding cassette 10 is attached to the body of the image forming apparatus 100 to feed the sheets 18 to the sheet conveyance path 11, while FIG. 5 shows a state where the sheet feeding cassette 10 has been withdrawn from the body of the image forming apparatus 100 so that the sheets 18 are supplied into the sheet feeding cassette 10. Moreover, it should be noted that, in the following descriptions, the width adjustment cursor 37*a* that is not provided with the restriction member 50 and the width adjustment cursor 37*b* that is provided with the restriction member 50 are distinctively referred to as a reference-side cursor and a pressing-side cursor, respectively.

The restriction member 50 is swingably supported inside the pressing-side cursor 37*b* by a swing support shaft 50*a*, and has an arm portion 50*b*, a restriction portion 50*c*, and a pressed portion 50*d*. Between the restriction portion 50*c* and an inner wall surface of the pressing-side cursor 37*b*, a compression coil spring 51 is disposed, and the restriction member 50 is biased by the compression coil spring 51 in the counterclockwise direction in FIG. 4. Instead of the compression coil spring 51, a twist spring may be attached to the swing support shaft 50*a* of the restriction member 50.

The arm portion 50*b* extends upward from the swing support shaft 50*a* along the inner wall surface of the pressing-side cursor 37*b*. The restriction portion 50*c* is formed at an upper end portion of the arm portion 50*b* so as to be able to appear and disappear through an opening 53 formed in an opposing surface 52 of the pressing-side cursor 37*b* that faces the side end portion 18*a* of the sheets 18. The pressed portion 50*d* projects from a lower end portion of the arm portion 50*b* outward in the sheet width direction (the A direction in FIG. 4) to face an under surface of the sheet stacking plate 28. The projection direction of the pressed portion 50*d* is at an acute angle with respect to the restriction portion 50*c* direction (extending direction of the arm portion 50*b*).

Next, descriptions will be given of operations of supplying the sheets 18 to, and feeding the sheets 18 out of, the sheet feeding cassette 10. When supplying the sheets 18 to the sheet feeding cassette 10, the sheet feeding cassette 10 is withdrawn from the body of the image forming apparatus 100, and as shown in FIG. 5, the sheet stacking plate 28 is pressed against the bottom of the cassette base 25 to compress the compression spring 57. Thereby, the sheet stacking plate 28 is brought into a locked state where it is locked with the locking claw of the lock release member 41 (see FIG. 2).

At this time, since the pressed portion 50*d* of the restriction member 50 is pressed down by the sheet stacking plate 28, the restriction member 50 swings about the swing support shaft 50*a* in a clockwise direction while compressing the compression coil spring 51.

As a result, the restriction member 50 is located at a position (first position) where the restriction portion 50*c* is retracted inside the pressing-side cursor 37*b* through the opening 53 formed in the opposing surface 52 of the pressing-side cursor 37*b*. Thus, the sheets 18 can be smoothly set on the sheet stacking plate 28, without pressing in the restriction member 50 or widening a gap between the reference-side cursor 37*a* and the pressing-side cursor 37*b*.

When the sheet feeding cassette 10 to which the sheets 18 have been supplied is inserted into the body of the image forming apparatus 100 by a predetermined amount of distance, the lock release member 41 (see FIG. 2) is pushed into the sheet feeding cassette 10, and thereby, as shown in FIG. 4, the locked state of the sheet stacking plate 28 with respect to the bottom of the cassette base 25 is released, and the sheet stacking plate 28 moves upward. As a result, the restriction member 50 is located at a position (second position) where the restriction portion 50*c* projects through the opening 53 of the pressing-side cursor 37*b* to the sheets 18 side (in the A' direction in FIG. 4).

The rise of the sheet stacking plate 28 causes the side end portion 18*a* of an upper plurality of sheets of the sheets 18 to contact the restriction portion 50*c* biased to project through the opening 53, and thus the upper plurality of sheets of the sheets 18 are set at the sheet feeding position. In this state, the stack of sheets 18 are separated from each other one by one to be fed out by the pickup roller and the sheet feeding roller pair (neither is shown) which are provided on the image forming apparatus 100 body side.

With decrease of the sheets 18 in number as a result of the sheet feeding, the sheet stacking plate 28 is caused to move upward by the compression spring 57. Thereby, the stack of sheets 18 are allowed to be positioned such that, by the side end portion 18*a* of an upper plurality of the sheets 18 contacting the restriction portion 50*c*, a topmost one of the sheets 18 is always located at the sheet feeding position. Moreover, in such part of the restriction portion 50*c* that projects from the opening 53, there are formed a restriction surface 55*a* that is parallel to the opposing surface 52 of the pressing-side cursor 37*b* and a slant surface 55*b* that is inclined from a lower end of the restriction surface 55*a* toward a lower edge of the opening 53. The slant surface 55*b* prevents the side end portion 18*a* of the sheets 18 from being caught by the restriction portion 50*c* when the sheet stacking plate 28 moves upward.

With the configuration according to the present embodiment, when the sheet stacking plate 28 is locked at the bottom of the cassette base 25, the restriction member 50 is located at the first position. Then, when the sheet feeding cassette 10 is inserted into the body of the image forming apparatus 100, the locked state of the sheet stacking plate 28 is released and also the restriction member 50 is located at the second position, and thereby, the position of the stack of sheets 18 placed on the sheet stacking plate 28 is restricted with the side end portion 18*a* of the upper plurality of sheets of the sheets 18 contacting the restriction portion 50*c*.

Thus, when additionally supplying new sheets 18 with some of the previously supplied sheets 18 still remaining on the sheet stacking plate 28, or when the side end portion 18*a* is uneven as in a case, for example, where the supplied sheets 18 are recycled paper sheets and where unprinted sides of used paper sheets are going to be used as the sheets 18, the sheets 18 can be smoothly set on the sheet stacking plate 28, without pressing the restriction member 50 or moving the reference-side cursor 37*a* or the pressing-side cursor 37*b*. Moreover, upper part of the stack of sheets 18 can be securely located at the sheet feeding position without strongly pressing the reference-side cursor 37*a* and the pressing-side cursor 37*b* against the side end portion 18*a* of the stack of sheets 18. This makes it possible to effectively reduce skew (oblique feeding) of the sheets 18 and misaligned printing even when the side end portion 18*a* of the sheets 18 is uneven and thus it is difficult to make the reference-side cursor 37*a* and the pressing-side cursor 37*b* contact the whole side end portion 18*a*.

Although the above descriptions have dealt with the sheet feeding cassette 10 where the sheet stacking plate 28 does not move downward when the sheet feeding cassette 10 is withdrawn from the body of the image forming apparatus 100, but instead, there may be adopted a configuration where the sheet stacking plate 28 moves downward to be locked at the bottom of the cassette base 25 when the sheet feeding cassette 10 is withdrawn. In that case, the configuration may be such that part of the sheet stacking plate 28 contacts a guide portion provided on the image forming apparatus 100 body side when the sheet feeding cassette 10 is withdrawn by a predetermined amount of distance to thereby allow the sheet stacking plate 28 to move downward against the biasing force of the compression spring 57 to be locked at the bottom of the cassette base 25 with the locking claw of the lock release member 41. With this configuration, where the restriction member 50 is located at the first position when the sheet feeding cassette 10 is withdrawn from the body of the image forming apparatus 100, it is not necessary to manually lock the sheet stacking plate 28, and this makes it possible to supply the sheets 18 in a more smooth manner.

Figure 6:
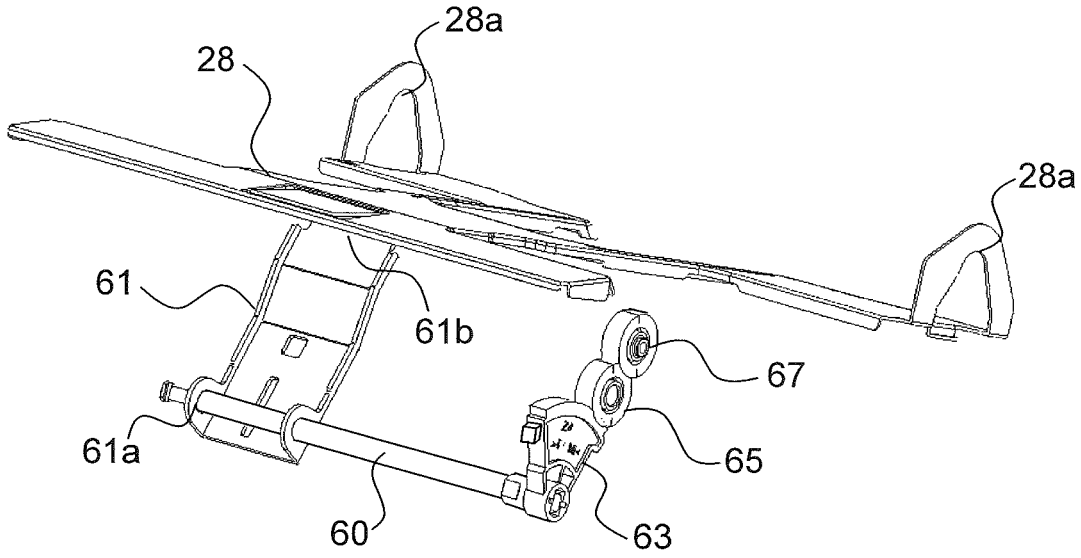
FIG. 6 is a perspective view showing a lift mechanism configured with an operation plate 60 to move up and down a sheet stacking plate 28.

Moreover, the lift mechanism for the sheet stacking plate 28 is not limited to the configuration where the compression spring 57 and the lock release member 41 are used, but instead, a configuration may be adopted where an operation plate is caused to rotate by a lift motor provided on the image forming apparatus 100 body side. FIG. 6 is a perspective view showing a lift mechanism for a sheet stacking plate 28 that uses an operation plate 61, showing a state where a free end 28*b* of the sheet stacking plate 28 is lifted by the operation plate 61.

As shown in FIG. 6, the sheet stacking plate 28 is supported at the inner side of the bottom of the cassette base 25 with an upstream-side end portion of the sheet stacking plate 28 with respect to a sheet feeding direction as a pivot 28*a*, and a downstream-side end portion of the sheet stacking plate 28 with respect to the sheet feeding direction is a free end 28*b* which is rotatable up and down. Below and in the vicinity of the free end 28*b* of the sheet stacking plate 28, there is disposed an operation plate drive shaft 60. The operation plate drive shaft 60 is rotatably held by a shaft bearing portion (not shown) formed at the inner side of the bottom of the cassette base 25. One end of the operation plate drive shaft 60 penetrates through a fixation hole 61*a*, and the operation plate drive shaft 60 and the operation plate 61 are fixed. The operation plate 61 is disposed in a position opposite a substantial center portion of the under surface of the sheet stacking plate 28 in the sheet width direction.

To the other end of the operation plate drive shaft 60, there is connected a fan-shaped gear 63. The fan-shaped gear 63 is connected to a drive input gear 67 via an idle gear 65. The drive input gear 67 is partially exposed from the cassette base 25, and when the sheet feeding cassette 10 is inserted in the image forming apparatus 100, the drive input gear 67 is connected to a drive output gear (not shown) provided on the image forming apparatus 100 body side. By being connected to the drive output gear provided on the image forming apparatus 100 body side, the drive input gear 67 constitutes a drive connection portion capable of transferring a driving force to the operation plate 61.

When the lift motor (not shown) provided on the image forming apparatus 100 side is driven to rotate to rotate the drive output gear, with the sheet feeding cassette 10 inserted in the image forming apparatus 100, the driving force is transferred to the operation plate drive shaft 60 via the drive input gear 67, the idle gear 65, and the fan-shaped gear 63, so that the operation plate 61 rotates in the counterclockwise direction in FIG. 6. As a result, a rotating-side edge 61*b* of the operation plate 61 slides along the under surface of the sheet stacking plate 28, to lift the free end 28*b* of the sheet stacking plate 28 upward.

Thereby, the topmost sheet of the stack of sheets 18 stacked on the sheet stacking plate 28 is brought into contact with the pickup roller provided in the image forming apparatus 100, and further, the sheets 18 are separated from each other one by one by the sheet feeding roller pair, starting from the topmost sheet, to be fed out.

By increasing the amount of rotation of the drive output gear in accordance as the stack of sheets 18 stacked on the sheet stacking plate 28 are fed out, the amount of rotation of the operation plate 61 is increased, and an angle formed between the bottom of the cassette base 25 and the operation plate 61 is enlarged. And, when all the sheets 18 are fed out from the sheet stacking plate 28, the operation plate 61 is located at a position where the operation plate 61 stands at a predetermined angle with respect to the bottom of the cassette base 25, and the free end 18*b* of the sheet stacking plate 28 rises to its uppermost position.

In a state where the sheet feeding cassette 10 is not inserted in the image forming apparatus 100 and the drive input gear 67 is not connected to the drive output gear provided on the image forming apparatus 100 body side, the operation plate 61 is located at a position where the operation plate 61 lies along the bottom of the cassette base 25. Thus, the free end 28*b* of the sheet stacking plate 28 is brought down to its lowermost position due to its own weight. Thus, in a case where the lift mechanism for the sheet stacking plate 28 as shown in FIG. 6 is employed, whenever the sheet feeding cassette 10 is withdrawn from the body of the image forming apparatus 100, the restriction member 50 is pressed by the weight of the sheet stacking plate 28 to be located at the first position, and thus, there is no need of manually locking the sheet stacking plate 28, and this makes it possible to supply the sheets 18 in a more smooth manner.

It should be understood that the present disclosure is not limited to the above embodiments, and various modifications are possible within the scope of the present disclosure. For example, the restriction member 50 is provided only on the pressing-side cursor 37*b* of the two width adjustment cursors 37*a*, 37*b* in the above embodiments, but instead, the restriction member 50 may be provided one on each of the reference-side cursor 37*a* and the pressing-side cursor 37*b*. Furthermore, the swing support shaft 50*a* of the restriction member 50 is disposed at the lower end of the arm portion 50*b* in the above embodiments, but instead, the swing support shaft 50*a* may be disposed in the vicinity of the central portion of the arm portion 50*b*. In that case, the compression coil spring 51 may be displaced from its position in FIGS. 4 and 5 to be located at a position facing the restriction portion 50*c*. However, if the swing support shaft 50*a* is disposed at the lower end of the arm portion 50*b* as in the above embodiments, the arm portion 50*b* swings by a larger amount with respect to the same amount of pressing by the pressed portion 50*d* than otherwise, and thus, it is possible to securely bring the restriction portion 50*c* into the first and second positions.

Moreover, the application of the present disclosure is not limited to the image forming apparatus 100 which is of the front loading type as shown in the above embodiments, but the present disclosure is applicable completely equally to an image forming apparatus where a sheet feeding cassette 10 is attached insertable/withdrawable in a direction parallel to the sheet feeding direction.

Moreover, the application of the present disclosure is not limited to a monochrome MFP as shown in FIG. 1, but the present disclosure is applicable also to other image forming apparatuses provided with a withdrawably attached sheet feeding cassette, including a color printer, a color MFP, a monochrome printer, a color MFP and a color printer provided with an inkjet image forming portion, etc.

Furthermore, the application of the present disclosure is not limited to image forming apparatuses, but the present disclosure is applicable also to an option feeder that is detachably connected to an image forming apparatus to feed sheets to the image forming apparatus.

The present disclosure can be employed in a sheet storage cassette that is withdrawably attached to an image forming apparatus and the like. The employment of the present disclosure makes it possible to provide, with a simple configuration, a sheet storage cassette that is capable of preventing sheet skew and allows a smooth sheet supply operation.

What is claimed is:

1. A sheet storage cassette, comprising:

a cassette base where sheets are stored;

a sheet stacking plate on an upper surface of which sheets are placed, and an upstream-side end portion of which in a feeding direction of the sheets is rotatably supported at a bottom of the cassette base;

a lift portion that moves the sheet stacking plate up and down between a lower limit position that is parallel to the bottom of the cassette base and that allows the sheets to be set on the sheet stacking plate and a sheet feeding position that allows the sheets to be fed out; and a pair of width adjustment cursors provided one on each side in a sheet width direction perpendicular to the feeding direction of the sheets, to be reciprocatingly movable in the sheet width direction, the sheet storage cassette being insertable and withdrawable with respect to a body of an image forming apparatus, wherein at least one of the width adjustment cursors includes:

an opposing surface that faces a side edge of the sheets placed on the sheet stacking plate;

an opening formed in the opposing surface;

a restriction member including an arm portion extending in an up-down direction of the width adjustment cursor, a restriction portion formed at an upper end portion of the arm portion so as to be selectively located at a first position where the restriction portion is retracted outward in the sheet width direction through the opening or a second position where the restriction portion projects outside inward in the sheet width direction from the opening to restrict a position of the side edge of the sheets, and a pressed portion extending from a lower end portion of the arm portion outward in the sheet width direction to project from a lower end portion of the width adjustment cursor to face an under surface of the sheet stacking plate;

a swing support shaft that swingably supports the arm portion of the restriction member; and a first biasing member that biases the restriction member so that the restriction portion swings in a direction of the second position; and wherein when the sheet stacking plate is located at the lower limit position with respect to the cassette base, the pressed portion is pressed by the sheet stacking plate into a pressed state to cause the restriction portion to swing in a direction of the first position against a biasing force of the first biasing member, and when the sheet stacking plate rises up to the sheet feeding position, the pressed state of the pressed portion is released and the restriction portion is caused to swing in the direction of the second position by the biasing force of the first biasing member.

2. The sheet storage cassette of claim 1, wherein the restriction portion of the restriction member incudes a restriction surface that is parallel to the opposing surface when the restriction portion is located in the second position and a slant surface that is inclined from a lower end portion of the restriction surface toward a lower edge of the opening when the restriction portion is located in the second position.

3. The sheet storage cassette of claim 1, wherein the restriction portion restricts the side edge of sheets of the sheets placed on the sheet stacking plate that are located at the sheet feeding position.

4. The sheet storage cassette of claim 1, wherein the swing support shaft is disposed at a lower end portion of the width adjustment cursor, and the pressed portion is disposed above the swing support shaft.

5. The sheet storage cassette of claim 1, wherein the opening is disposed above a downstream-side end of the width adjustment cursor in the feeding direction of the sheets.

6. The sheet storage cassette of claim 1, wherein the lift portion includes:

a second biasing member that is disposed between the bottom of the cassette base and the sheet stacking plate to bias an upstream-side end portion of the sheet stacking plate upward in the feeding direction; and a lock release member that is capable of locking the sheet stacking plate in a locked state with respect to the bottom of the cassette base against a biasing force of the second biasing member, and that is also capable of releasing the locked state; and the lock release member releases the locked state of the sheet stacking plate when the sheet storage cassette is inserted in the body of the image forming apparatus, and the sheet stacking plate is raised to the sheet feeding position by the biasing force of the second biasing member.

7. The sheet storage cassette of claim 6, wherein the lock release member engages with a swingable end of the sheet stacking plate to bring the sheet stacking plate into the locked state when the sheet stacking plate is pressed against the bottom of the cassette base, and the lock release member is disengaged from the swingable end of the sheet stacking plate to release the locked state of the sheet stacking plate when the sheet storage cassette is inserted in the body of the image forming apparatus.

8. The sheet storage cassette of claim 6, wherein when the sheet storage cassette is withdrawn from the body of the image forming apparatus, part of the sheet stacking plate comes into contact with a guide portion provided on a side of the body of the image forming apparatus, to thereby allow the sheet stacking plate to move down against the biasing force of the second biasing member, and the lock release member locks the sheet stacking plate at the bottom of the cassette base.

9. The sheet storage cassette of claim 1, wherein the lift portion includes:

an operation plate that is disposed between the sheet stacking plate and the cassette base to be rotatable between a position where the operation plate lies along the bottom of the cassette base and a position where the operation plate stands at a predetermined angle with respect to the bottom of the cassette base, the operation plate moving the sheet stacking plate up and down;

a drive shaft to which the operation plate is fixed such that the drive shaft and the operation plate rotate together; and a drive connection portion that is allowed to transfer a driving force to the operation plate when the sheet storage cassette is inserted in the body of the image forming apparatus to a predetermined position; and in a state where the sheet storage cassette is withdrawn from the body of the image forming apparatus, the operation plate is located at the position where the operation plate lies along the bottom of the cassette base, and the sheet stacking plate is located at the lower limit position.

10. The sheet storage cassette of claim 1, wherein the swing support shaft swingably supports the lower end portion of the arm portion.

11. The sheet storage cassette of claim 10, wherein the pressed portion projects in a direction that is at an acute angle with respect to a direction in which the arm portion extends.

12. An image forming apparatus comprising the sheet storage cassette of claim 1.

* * * * *